US007085392B1

(12) United States Patent
Garretson

(10) Patent No.: US 7,085,392 B1
(45) **Date of Patent: *Aug. 1, 2006**

(54) LOUDSPEAKER SOUND MODULATION APPLIANCE

(75) Inventor: Joseph K. Garretson, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 4 days.

This patent is subject to a terminal disclaimer.

(21) Appl. No.: 10/807,041

(22) Filed: Mar. 23, 2004

(51) Int. Cl.
*H04R 25/00* (2006.01)

(52) U.S. Cl. ..... 381/162; 381/165

(58) Field of Classification Search ..... 381/62, 381/161–166, 386, 396, 150, 189, 391; 181/143, 181/171, 181; 40/431, 433; 362/257, 279; 310/81

See application file for complete search history.

(56) References Cited

U.S. PATENT DOCUMENTS

| | | | | |
|---|---|---|---|---|
| 3,174,579 | A * | 3/1965 | Leslie | 181/143 |
| 3,315,760 | A * | 4/1967 | Schwendener | 181/143 |
| 3,902,015 | A * | 8/1975 | Edwards et al. | 381/62 |
| 4,253,368 | A * | 3/1981 | Leslie et al. | 84/706 |
| 4,817,163 | A * | 3/1989 | Stastny | 381/150 |

* cited by examiner

*Primary Examiner*—Huyen Le
(74) *Attorney, Agent, or Firm*—William W. Haefliger

(57) ABSTRACT

In combination with a loudspeaker assembly that includes a speaker diaphragm that is displaced to produce sound, the combination comprising a spinner element mounted to rotate in the path of sound waves produced by the speaker diaphragm; and a rotary drive for rotating the spinner, the spinner defining sound wave passing through openings, in said path.

20 Claims, 4 Drawing Sheets

LOUDSPEAKER SOUND MODULATION APPLIANCE

BACKGROUND OF THE INVENTION

This invention relates generally to accessories to loudspeakers, as for example are used in the instrument panels of vehicles, or for other purposes. More particularly it concerns a rotating element or spinner positioned in the path of sound waves produced by the speaker.

There is need for loudspeaker accessories characterized as producing motion to complement the sound, such as music, produced by such speakers.

SUMMARY OF THE INVENTION

It is a major object of the invention to provide a moving accessory meeting the above need, and which can be integrated with the speaker or its cabinet or housing.

In this regard, the invention is provided by:

a) a spinner element mounted to rotate in the path of sound waves produced by the speaker diaphragm; and b) a rotary drive for rotating the spinner, c) the spinner defining sound wave passing through openings, in said path.

As will be seen, the spinner may comprise a disc substantially spanning the sound wave path, to provide for sound wave modulation.

A further object is to provide a spinner that includes:

i) a hub, and ii) spaced apart arms extending outwardly from said hub.

As will be seen the arms may have spaced apart extents between which the openings are formed.

Another object is to provide the drive to comprise an electric motor positioned between said diaphragm and said spinner. The motor is typically positioned between said diaphragm and said hub, and operatively connected to the hub. The motor is preferably carried by an interior support carried by a front plate defined by the loudspeaker assembly.

An added object is to provide speaker arms having varying widths along arm lengths which extend generally radially. The arms may typically rotate the spinner at a speed causing audible modulation of said sound waves passing through the openings, between the arms. The diaphragm of the speaker is typically a woofer producing low frequency sound waves that are "chopped" by the spinner, the concave side of the woofer facing toward the spinner.

These and other objects and advantages of the invention, as well as the details of an illustrative embodiment, will be more fully understood from the following specification and drawings, in which:

DRAWING DESCRIPTION

DETAILED DESCRIPTION

Figure 1:
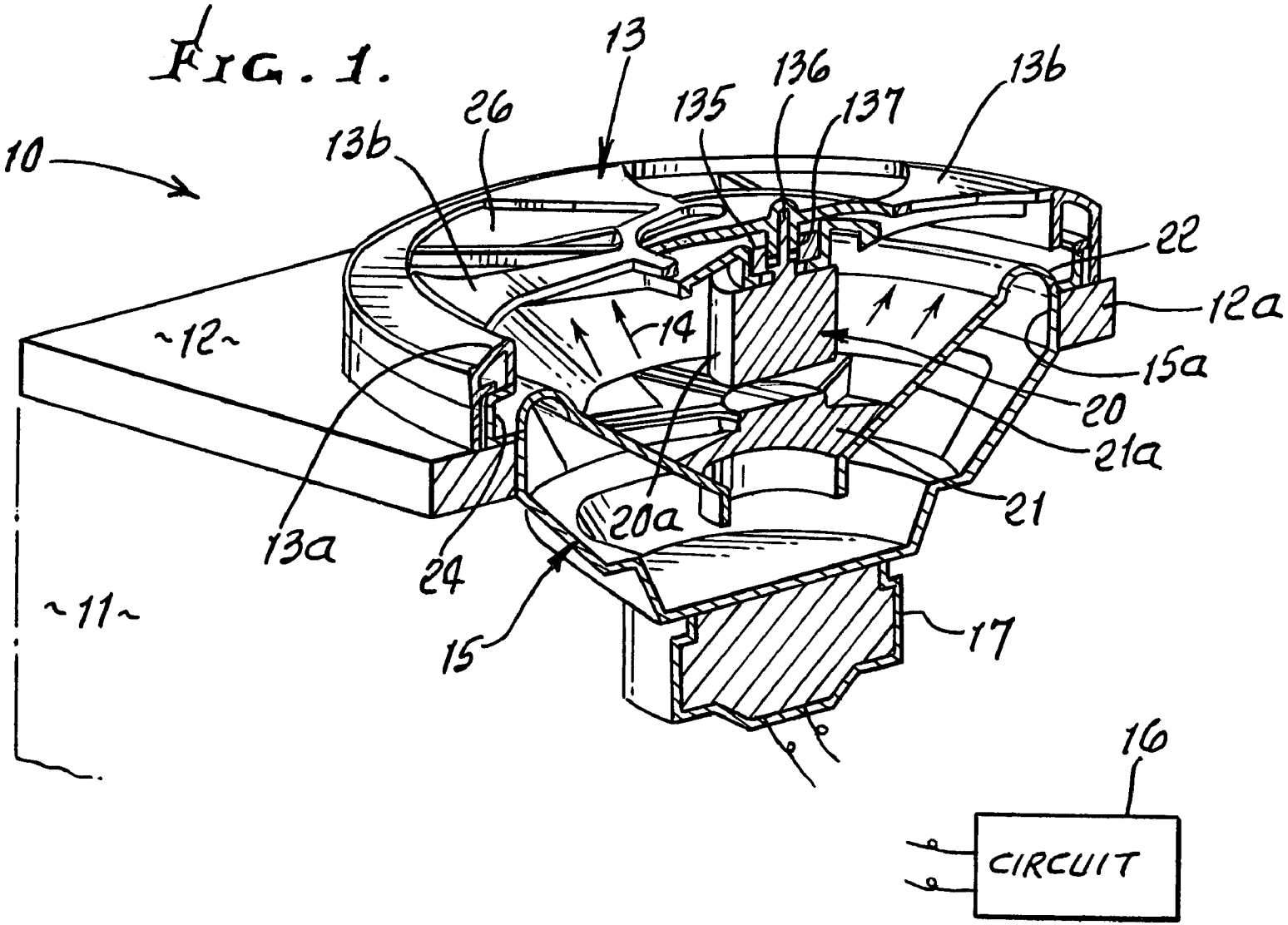
FIG. 1 is a cutaway perspective view of a preferred device incorporating the invention.

In the drawings, a loudspeaker assembly 10 includes a box 11 having a front plate 12. The box may comprise a housing for a speaker, as may be incorporated in or on a vehicle instrument panel.

Associated with plate 12 is a spinner 13 mounted to rotate in the path or paths (see arrows 14) of sound waves produced by a speaker diaphragm 15. A circuit to drive the diaphragm is indicated at 16, and an actuator mechanism at 17.

A rotary drive, such as an electric motor 20 is positioned, as between the diaphragm and spinner, to rotate the spinner. The drive housing 20*a*, is typically carried by a support 21, in the form of a stationary ring 21*a* peripherally carried at 22 by a mounting annular portion 12*a* of plate 12. The outer annular extent 15*a* of diaphragm 15 may also be carried by 12*a*. Annular portion 12*a* also carries an upstanding mounting ring 24 peripherally surrounded by the spinner, i.e. at outer edges of the spinner rim 13*a*.

Figure 2:
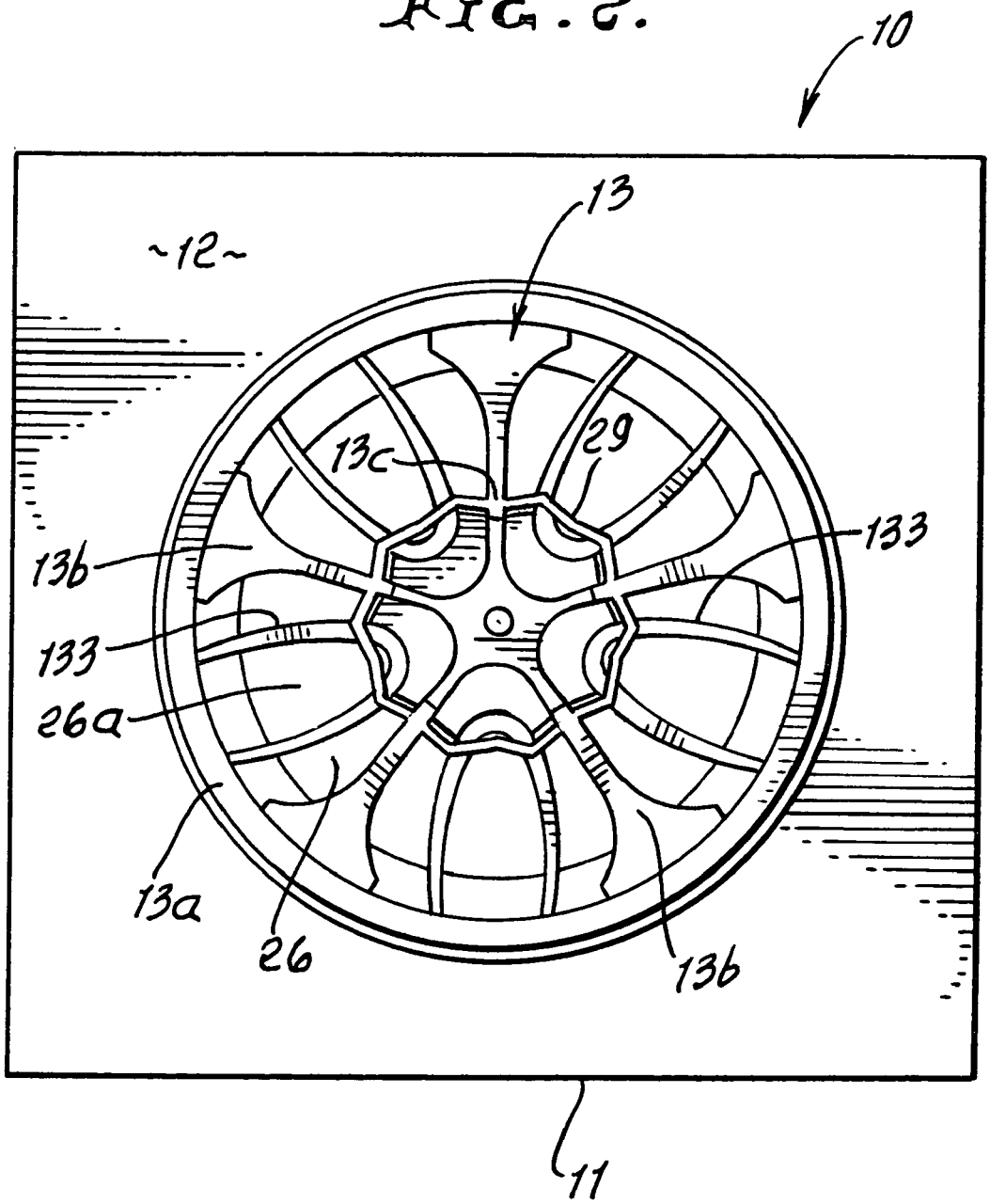
FIG. 2 is a top plan view of the FIG. 1 device.
Figure 3:
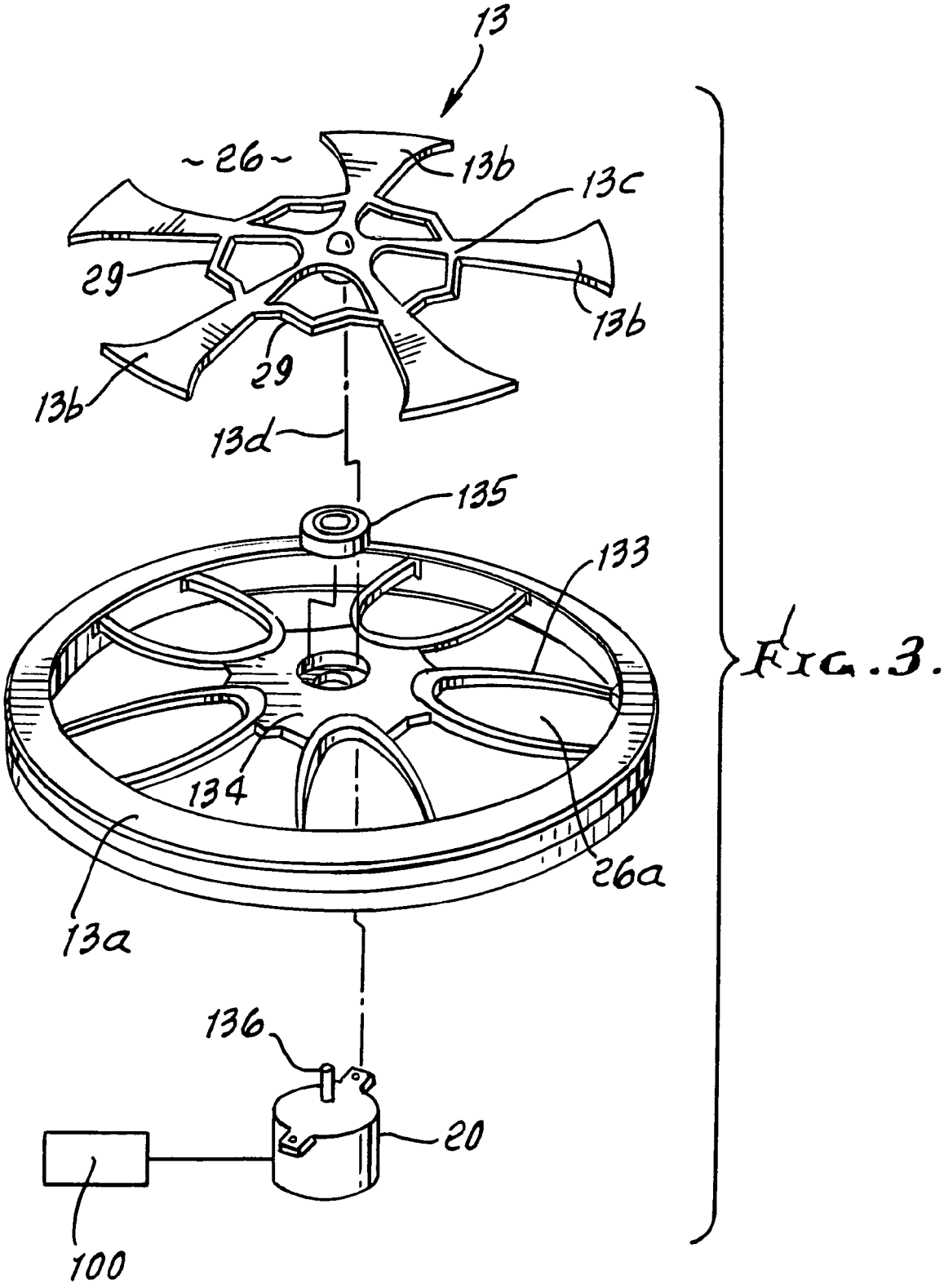
FIG. 3 is a perspective exploded view of the spinner and of a positioning ring.
Figure 4:
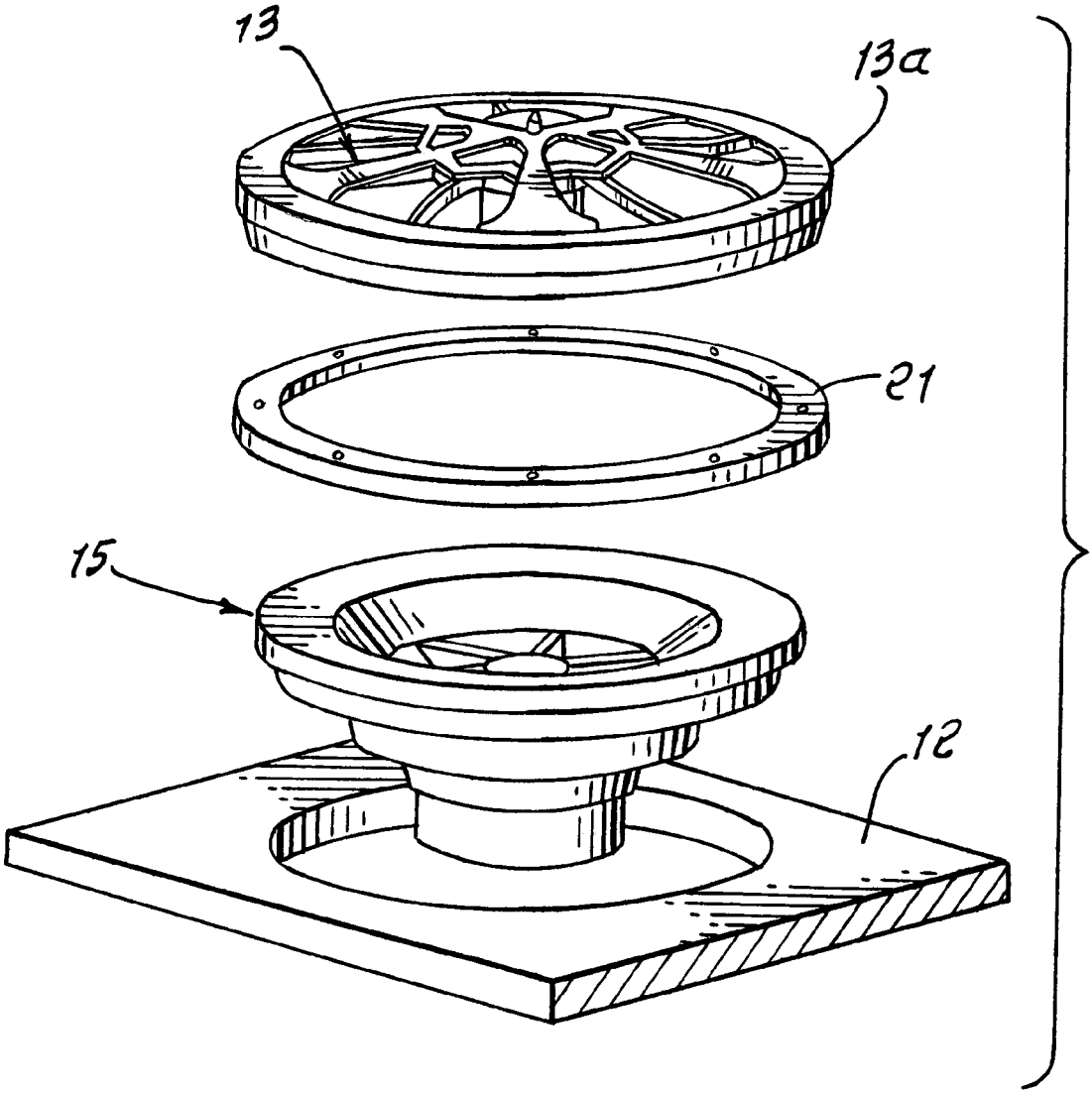
FIG. 4 is a perspective exploded view of the positioning ring, a mounting rim, and a loudspeaker diaphragm, as shown in FIG. 1.

Openings 26 are formed between the spaced apart arm 13*b* of the spinner, to pass sound waves produced by diaphragm 15 and directed through the spinner, which substantially spans, transversely, the path or paths of such waves 14. The arms 13*b* are preferably of widths which increase radially outwardly, as seen in FIG. 2. Narrow braces 29 interconnect successive arms, at their lesser widths extents 13*c*, outwardly of the spinner axis 13*d* of rotation, for safety. See also non-rotating arms 133 projecting generally radially and also forming openings 26*a* outwardly of a fixed hub 134. The latter carries a bearing 135 for the motor shaft 136 and sleeve 137, which carries the spinner.

FIG. 1 shows drive shaft 136 projecting upwardly into the spinner sleeve. Annular bearing 135 is positioned between the spinner hub sleeve 137, which rotates, and hub 134 carried by the support 21.

In operation, the drive preferably rotates the spinner at a speed causing audible modulation of said sound waves passing through said openings between the arms, as by chopping. Such modulation is enhanced by the provision of the variable width spinner arms, as described. Note also the diaphragm 15, preferably a woofer, is generally concave toward the spinner. The drive is generally centrally located at an axis defined by the spinner, and supports the spinner for rotation, the drive located between the spinner and diaphragm.

A control 100 may be operatively connected to the motor 20, to vary its rotary speed, to vary the sound wave modulation effect. Control 100 may be manually controllable.

I claim:

1. In combination with a loudspeaker assembly that includes a speaker diaphragm that is displaced to produce sound, the combination comprising a) a spinner mounted to rotate in the path of sound waves produced by the speaker diaphragm; and b) the spinner defining sound wave passing through openings, in said path, c) the spinner comprising i) a hub, and ii) spaced apart arms extending outward from said hub, d) and including a drive that rotates the spinner at a speed causing said arms to audibly modulate sound waves passing through openings between the arms, e) the arms having varying widths along arm lengths which extend generally radially, f) and including braces in the path of said sound waves and connected to the arms at locations along their lengths.

2. The combination of claim 1 wherein the spinner substantially spans said path.

3. The combination of claim 1 wherein said arms have spaced apart extents between which said openings are formed.

4. The combination of claim 1 wherein said drive comprises an electric motor positioned between said diaphragm and said spinner.

5. The combination of claim 1 wherein said drive comprises an electric motor positioned between said diaphragm and said hub, and operatively connected to the hub.

6. The combination of claim 1 including a front plate defined by said assembly, the plate defining an aperture in alignment with said openings, the plate carrying the diaphragm.

7. The combination of claim 6 including an interior support carried by the plate and carrying the drive.

8. The combination of claim 7 including a mounting ring carrying said support and carried by said plate.

9. The combination of claim 8 wherein the spinner also has narrow arm pairs that terminate at or proximate said braces.

10. The combination of claim 9 wherein said arms have spaced apart extents between which said openings are formed.

11. The combination of claim 1 wherein said braces form an undulating loop configuration.

12. In combination with a loudspeaker assembly that includes a speaker diaphragm that is displaced to produce sound, the combination comprising a) a spinner mounted to rotate in the path of sound waves produced by the speaker diaphragm;

b) the spinner defining sound wave passing through openings, in said path, c) the spinner comprising, i) a hub, and ii) spaced apart arms extending outwardly from said hub, d) the arms having varying widths along arm lengths which extend generally radially, e) and including braces in the path of said sound waves and connected to the arms lesser widths at locations along their lengths, f) said braces extending in a generally looping direction or directions about an axis defined by the spinner.

13. In combination with a loudspeaker assembly that includes a speaker diaphragm that is displaced to produce sound, the combination comprising a) a spinner mounted to rotate in the path of sound waves produced by the speaker diaphragm;

b) the spinner defining sound wave passing through openings, in said path, c) the spinner comprising, i) a hub, and ii) spaced apart arms extending outwardly from said hub, d) the arms having varying widths along arm lengths which extend generally radially, e) and including a drive that rotates the spinner at a speed causing said varying width arms to discernibly and audibly modulate sound waves passing through the openings between the arms, f) and including braces in the path of said sound waves and connected to the arms lesser widths at locations along their lengths, g) said braces extending in a generally looping direction or directions about an axis defined by the spinner.

14. The combination of claim 13 including said diaphragm that is generally concave toward the spinner.

15. The combination of claim 14 wherein the drive is generally centrally located at an axis defined by the spinner, and supports the spinner for rotation, the drive located between the spinner and diaphragm.

16. In combination with a loudspeaker assembly that includes a speaker diaphragm that is displaced to produce sound, the combination comprising a) a spinner mounted to rotate in the path of sound waves produced by the speaker diaphragm; and b) the spinner defining sound wave passing through openings, in said path, c) the spinner comprising, i) a hub, and ii) spaced apart arms extending outwardly from said hub, d) the arms having varying widths along arm lengths which extend generally radially, e) and including a drive that rotates the spinner at a speed causing said varying width arms to discernibly and audibly modulate sound waves passing through the openings between the arms, f) and including braces in the path of said sound waves and connected to the arms lesser widths at locations along their lengths.

17. The combination of claim 16 wherein the spinner substantially spans said path.

18. The combination of claim 16 including a front plate defined by said assembly, the plate defining an aperture in alignment with said openings, the plate carrying the diaphragm.

19. The combination of claim 18 including an interior support carried by the plate, and a mounting ring carrying said support and carried by said plate.

20. The combination of claim 16 including said diaphragm that is generally concave toward the spinner.

* * * * *